United States Patent [19]

Krauland, Jr.

[11] Patent Number: 4,526,026

[45] Date of Patent: Jul. 2, 1985

[54] METHOD AND APPARATUS OF PRODUCING CONTINUOUS THREE-DIMENSIONAL FABRICS

[76] Inventor: Konrad L. Krauland, Jr., 43 Ascan Ave., Forest Hills, N.Y. 11375

[21] Appl. No.: 599,254

[22] Filed: Apr. 11, 1984

[51] Int. Cl.[3] ..... D04B 35/00

[52] U.S. Cl. ..... 66/1 R; 139/22; 139/14

[58] Field of Search ..... 66/11; 139/22, 14

[56] References Cited

U.S. PATENT DOCUMENTS 4,183,232 1/1980 Banos et al. ..... 66/11

4,410,015 10/1983 Koller et al. ..... 139/11 X 4,492,096 1/1985 Cahuzac ..... 66/11

*Primary Examiner*—Ronald Feldbaum

[57] ABSTRACT

A method and device for forming a three-dimensional fabric continously is disclosed. The fabric has a plurality of warp yarns arranged in a two-dimensional array and two sets of weft yarns are interwoven with the weft yarns to form alternate courses. The courses of corresponding weft yarns are interlocked at opposite sides to form a fabric with high dimensional stability to resist deforming. The method and device can be operated at high speed to produce fabrics of any length.

9 Claims, 16 Drawing Figures

FIG.1
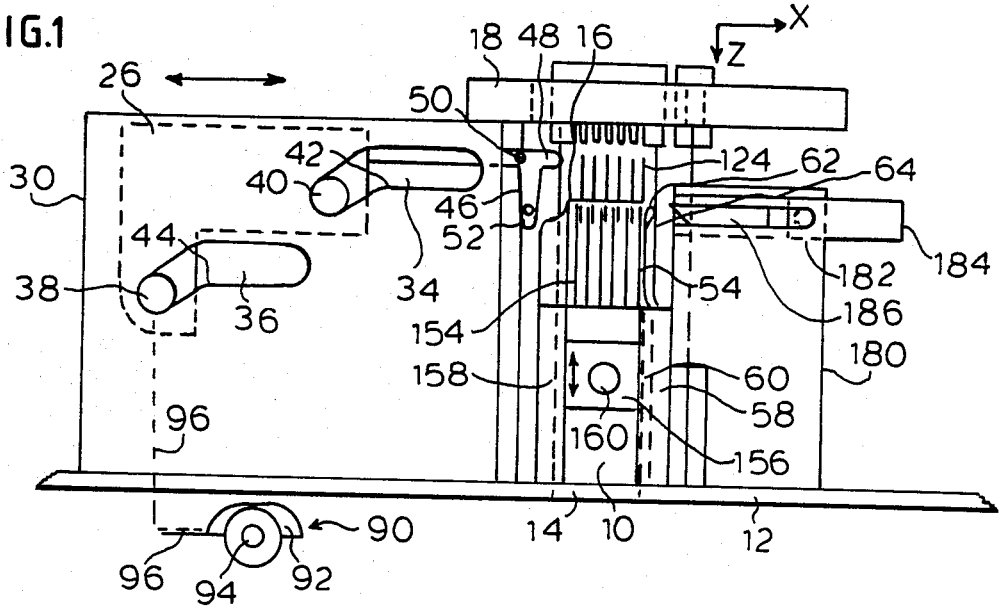
FIG.2
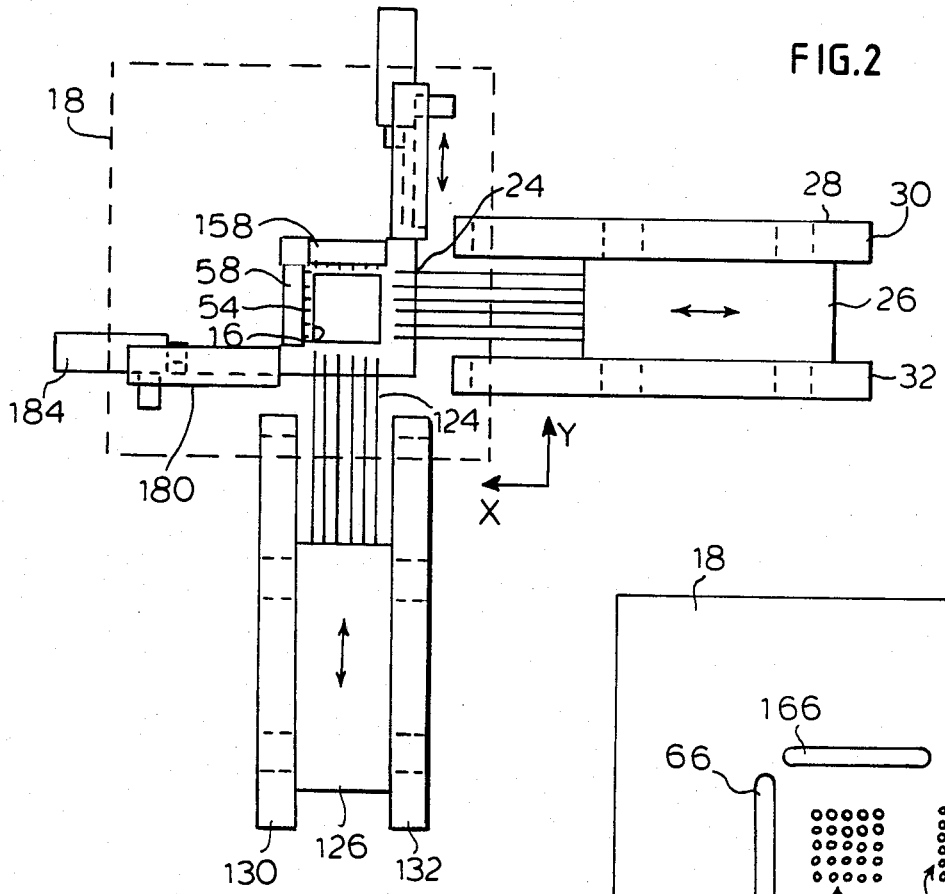
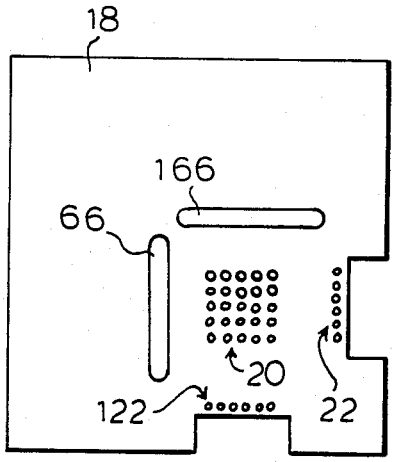
FIG.3

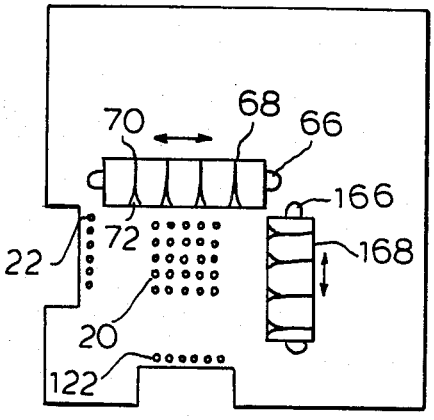
FIG.4
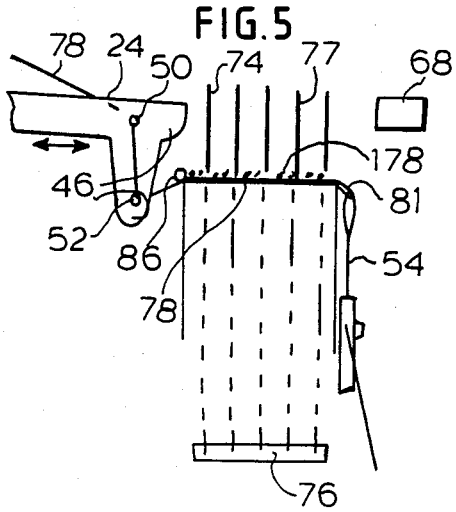
FIG.5
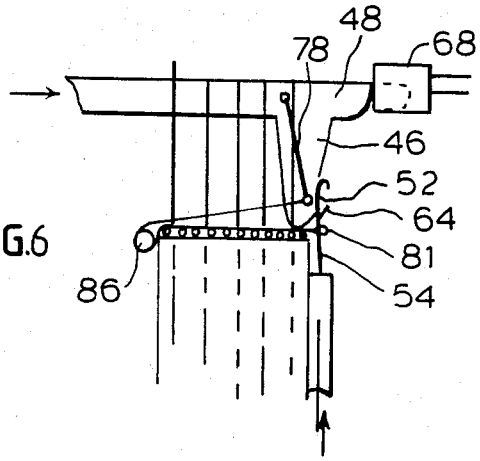
FIG.6
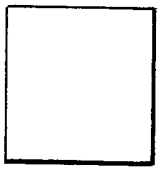
FIG.8a
FIG.7
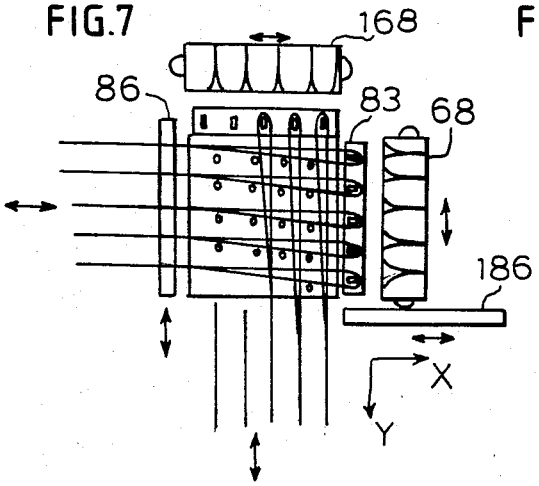
FIG.8b
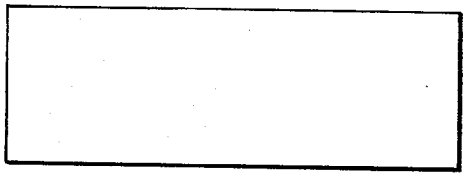
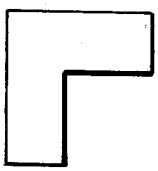
FIG.8c
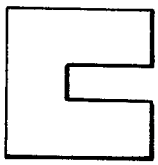
FIG.8d

METHOD AND APPARATUS OF PRODUCING CONTINUOUS THREE-DIMENSIONAL FABRICS

BACKGROUND OF THE INVENTION

1. Field of Invention

This invention pertains to three dimensional fabrics, and more particularly three dimensional fabrics having a continuous length in at least one dimension, and an apparatus for producing the same.

2. Description of the Prior Art

With the advent of modern fibers, three-dimensional fabrics have become candidates for structural members. These fibers include various synthetic materials, as well as graphite, silicon, boron, ceramic, glass or other similar filaments which until recently have not been associated with fabrics. Typically, a three-dimensional lattice is made of the fibers. The lattice is then impregnated with a reinforcing material such as a resin or ceramic, matrix. In the case of metal matrix composites, (or by the use of pre-impregnated yarns) the matrix may be woven right in, and cured by heat, etc. (uv). After the assembly has cured and solidified it could be reduced to its final shape by machining or other similar well-known methods.

However most of the methods to produce such fabrics was tedious because they did not lend themselves to automation. Furthermore, many methods and devices were capable of producing only fabrics of finite shapes and dimensions.

U.S. Pat. Nos. 4,080,915 and 3,904,464 illustrate the present state of the art.

OBJECTIVES AND SUMMARY OF THE INVENTION

An objective of the present invention is to provide a method and device for making continuously a three-dimensional fabric.

Another objective is to provide a method and device for making three-dimensional fabrics of different cross-sections.

A further objective is to provide a device which can be automatically operated at high speeds.

Yet a further objective is to provide a three-dimensional fabric which is relatively strong and is resistant to distortive forces.

These and other objectives and advantages shall become apparent in the following description of the invention. A three-dimensional fabric, made in accordance with this invention comprises a plurality of warp yarns arranged in a predetermined array, and two sets of orthogonal weft yarns interwoven with the warp yarns. The sets are laid in alternate courses and each course is interconnected at the opposed ends with the previous course of the same set.

The device for making the above fabric comprises a forming bed constructed and arranged so that it moves with respect to warp yarns, or vice versa the warp yarns move with respect to the bed while the fabric is woven. Means are provided to move in a reciprocating manner the yarns of each weft set in and out of the warp yarn matrix in cyclical strokes. Further means are provided for interlocking each weft course with a previous weft course of the same set in the middle of each stroke.

BRIEF DESCRIPTION OF THE DRAWINGS

FIG. 1 shows a side view of the apparatus constructed according to the invention;

FIG. 2 shows a plan view of the apparatus of FIG. 1 with the top plate removed;

FIG. 3 shows a plan view of the top plate;

FIG. 4 shows a bottom view of the top plate;

FIGS. 5–7 show the relative positions of different elements of the invention during operation;

Figure 8E:
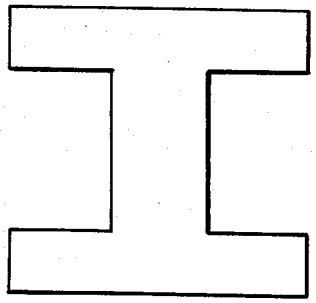
Figure 10:
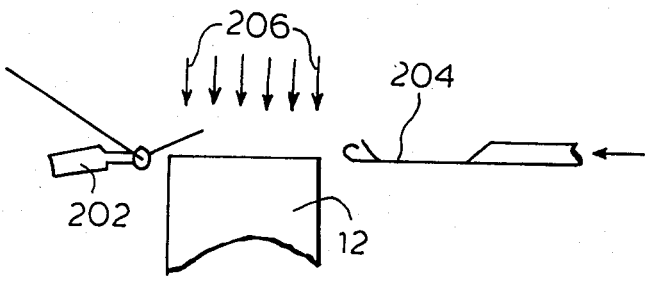
Figure 11:
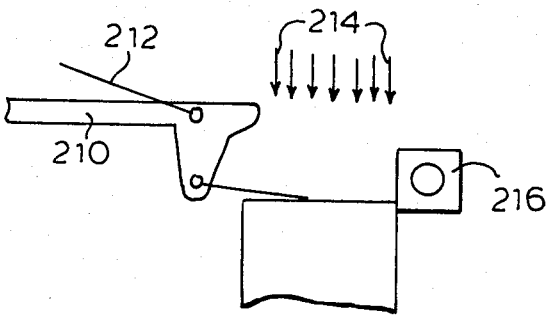
Figure 9:
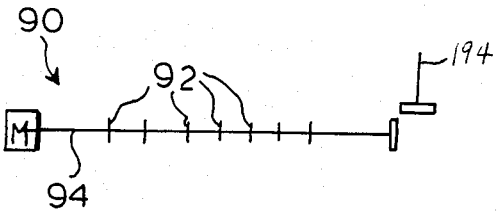

FIGS. *8a–e* show the different types of cross-sections of three-dimensional fabrics that could be made with the apparatus;

FIG. 9 shows a mechanism for driving the members of FIGS. 1–7;

FIGS. 10 and 11 show alternate embodiments of the apparatus; and

Figure 12:
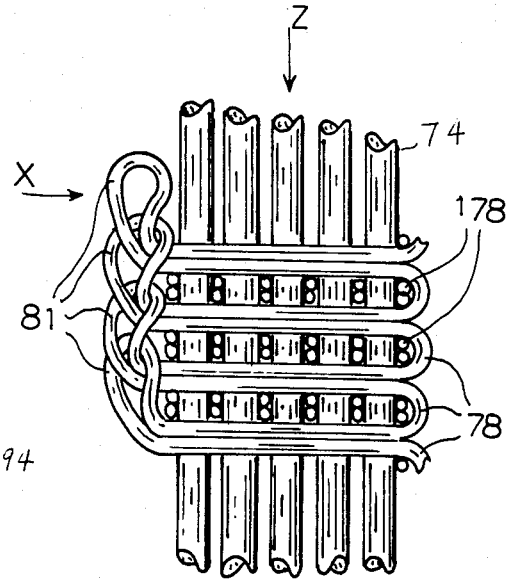

FIG. 12 shows a longitudinal sectional view of the fabric made in accordance with each invention.

DETAILED DESCRIPTION OF THE INVENTION

The apparatus for making three-dimensional fabrics, its method of operation and the structure of the fabrics shall now be described. It should be understood that in the following description the terms up, down, left, right and so on shall be used only for the sake of clarity and that the subject apparatus may operate in various other positions.

The apparatus is adapted two weave to two orthogonal weft yarns are alternately in the X and Y direction (shown in FIG. 2) around warp yarns extending in the Z direction, said Z direction being generally perpendicular to the plane defined by X and Y.

A fabric former bed 10 is secured perpendicularly to a base 12. The bed is hollow and its internal cavity is continuous with an opening 14 through base 12 allowing the fabric formed on the top face 16 of the bed to be drawn through the bed and base in a continuous fashion. A top plate 18 is disposed above the bed and it is provided with three groups of holes. The first group 20 guides the warp yarns towards the former bed 10 as can be seen from this guide the warp yarns are arranged in a preselected array of rows and columns X and Y. The weft yarns are woven between these warp yarns, with one set of weft yarn X being pushed along the rows of the array while the other set Y of weft yarns is pushed along the array columns. The second group of holes 22 guides the X weft yarns while the third group 122 guides the Y yarns. (The elements for weaving the X-yarns are identified from here on by two digit numbers while the corresponding elements for the Y yarns are indicated by the numeral 1 followed by the same number). The warp and weft yarns have been omitted from FIGS. 1–4 for the sake of clarity. A plurality of horizontal yarn guides 24 are mounted on a yarn guide push assembly 26. All the yarn guides have the same length and are disposed in parallel with each other as shown. The assembly 26 in its turn is mounted on yarn guide holder comprises two vertical spaced plates 30, 32 with two elongated holes 34, 36. The assembly 26 is provided with mounting pins 38, 40 (on each side of the assembly) which fit in and ride the lower camming surfaces 42, 44 of holes 34, 36 respectively.

Each yarn guide 24 is terminated in a vertical L-shaped head defined by a first leg 46 extending downward from the main body of the respective yarn guide, and a second, relatively shorter, leg 48. The yarn guide is relatively thin so that it can slip with ease between the warp yarns. This movement is facilitated by the short leg 48. The yarn guide is also provide with a first hole 50 and a second hole 52 disposed at the upper and lower ends of leg 46 as shown.

It is clear from FIG. 1 that the motion of assembly 26 (and therefore the yarn guides) is limited by the shape and size of holes 34, 36. Preferably these holes are arranged and disposed so that in the farthest position of the assembly 26 from former bed 10, (FIG. 1) the guide members are adjacent to the bed. As the assembly moves toward the bed the yarn guides move across the top of the former bed until they move past the bed. As shown in FIG. 1, the holes 34, 36 are shaped so that in the farthest position of the assembly from the former bed, the lower end of leg 46 of each yarn guide is disposed slightly below the top surface 16 of the bed. As the assembly is moved toward the bed (in the X direction) camming surfaces 42, 44 force the assembly diagonally upward to insure that leg 46 clears the top of the former bed.

Mounted on, or adjacent to fabric former bed 10 are a plurality of needles 54. Preferably each needle 54 is mounted in parallel on needle assembly 56. The needles 54 extend vertically, as shown. Assembly 56 is secured between two vertical guides 58 which allow the assembly to move freely up and down (i.e. in the direction). The assembly 56 is provided with a hole 60 which is provided so that an activating rod (not shown) can engage the assembly to move the needles 54 as required.

Each needle 54 ends in an upper curved head 62 and beneath the head 62 there is a (has p) 64 pivotably connected to the needle shaft which may rotate in the vertical plane. These types of needles are well-known in the knitting industry. The needles and their assembly is arranged and disposed so that they can move between a lower position (shown in FIG. 1) in which needle head 62 is below the top surface 16 of the former bed 10 to an upper position (shown in FIG. 6).

There is also a yarn retainer mechanism 80 which is also secured to the base 12 as shown. Near its upper end the mechanism has a transversal, i.e. horizontal slot 82 which houses a retainer bar 84. The retainer bar is free to move horizontally in a transversal direction (i.e. Y) with respect to yarn guides 24. The bar ends in a pointed tip 86, and is provided with a pin 88 provided to engage a retainer bar activating rod (not shown).

The top plate 18 may be affixed to walls 30, 32, 130, 132 of the yarn guide holders. In addition to holes 20,22, 122 the top is also provided with two elongated openings 66, 166. On the bottom side of the top plate (see FIG. 4) a guide deflector assembly 68 is mounted on opening 66 in such a manner that the assembly is movably by longitudinally along opening 66. The guide deflector 68 has a plurality of slots 70 extending transversally across its width. Preferably one end of each slot is slightly enlarged as at 72. Except at 72, the width of each slot is slightly larger than the width of the yarn guides. The guide deflector 68 is positioned so that each of slots is facing a corresponding yarn guide across the former bed.

The operation of the apparatus is now described in conjunction with FIGS. 5–7. Initially yarns form separate spools (not shown) are threaded through the appropriate holes of top plate 18. The warp yarns 74 are secured to a member 76 disposed within or underneath former bed and used to tension said warp yarns and to draw the formed fabric downward; away from surface 16. The weft yarns are each threaded through the top 50 and bottom 52 holes of the respective yarn guides 4. FIG. 5 shows the initial position of yarn guide 24. In a previous cycle weft yarn 78 has been pulled through warp yarns 77 around needle 54, forming a loop 81 and back through warp yarns 74 so that it now extends toward guide 24 blow retainer bar 86. The second set of weft yarns 178 lie on top of the first set 78 as shown.

For the next course, the yarn guide 24 starts moving toward guide deflector 68. As previously explained, because of the shape of holes 34, 36 in yarn guide holder 30, the yarn guide first rises at an angle with respect to horizontal so that the extreme lower end of 48 clears the retainer bar 86, and the yarns of the second set 178. Once passed there obstacles the yarn guide moves essentially horizontally. Simultaneously needle 54 rises upward with loop 81 remaining on the shaft but shifting to the base of the needle knocking the hasp over. Preferably the movements of the yarn guide 24 and needle 54 are synchronized so that they reach their extreme position substantially at the same time. While the yarn guides weave the weft yarn through the warp yarns in the X direction its lower leg 46 tamps down the Y weft yarns underneath. As shown in FIG. 6, the guide deflector is positioned so that the short leg or nose 48 of the yarn guide 24 reaches the guide deflector just as lower hole is approximately even with needle 54. From this point on the yarn guide slips into the corresponding slit 70 within the guide deflector until the lower leg 46 moves past needle 54. Next, the guide deflector moves in the Y direction transversally to the yarn guide until leg 46 passes yarn 78 across the face of needle 54. The yarn guide 24 is then moved back toward its original position. However since its nose 48 is still engaged by guide deflector 68, the leg 46 moves past the opposite side of needle 54 so that yarn 78 is looped around needle head 62. As the yarn guide moves back, the retainer bar is retracted releasing some yarn 78. The extra slack is taken up by the yarn guide, thus tightening the new loop formed on the needle. This same action also pulls the yarn 78 snugly around the warp and weft yarns disposed adjacent to yarn 78 at the starting point of yarn guide 24. Once the yarn guide 24 completes its stroke, the needle 54 moves down. Since the loop 81 formed in the previous course, is maintained in its position by the tension of the yarn the new loop 83 (FIG. 7) is pulled through old loop 81 by needle 54. It can be seen that in this manner each warp yarn of a course is interlocked or secured to the previous course. This motion also performs the fabric edge on the side opposite needle 54. When the yarn guide completes its cycle the retainer bar is moved back, to lie transversally across the yarns as shown in FIGS. 5 and 7. The purpose of the yarn retainer is to keep the respective weft yarns from jamming up against the Z-warp yarns during the weaving process. Now a course is laid in the y direction. Thus consecutive courses in the X and Y directions are laid in an identical fashion, continuously and the formed fabric is drawn through the former bed.

The cross-sectional shape of the formed fabric is determined by the pre-selected array of the warp yarns. In FIGS. 1–7 a $5\times5$ square array has been selected. For this array six yarn guides are positioned in both X and Y directions. In general for an $N\times M$ array $N+1$ yarn guides are needed in one direction and $M+1$ yarn guides are needed in the other. In this manner the warp yarns are woven to both the X and Y yarns. Alternatively, the last guide yarn in either the X- and Y-direction may be omitted.

The warp yarns may be formed into any desired array. For example, they may be arranged to form a fabric having a square, rectangular, L-shaped, U-shaped or H-shaped cross-section. These various alternatives are shown in FIGS. 8*a–h*. Of course the former bed, yarn guides and needles must be laid out accordingly.

A drive mechanism 90 is provided preferably underneath 12 as a motive means for operating the different members of the device. As shown somewhat schematically in FIG. 9, the mechanism 90 comprises a motor 90 which turns shift 94 at a continuous speed. Mounted on the shaft are a plurality of cams 92 for activating each element. The cams are mounted on the shaft at a predetermined angle so that each element is operated at the proper time. Cams 92 are operatively connected by rods (such as rods 96 in FIG. 1) to the respective elements (such as the yarn guide assembly 26) to convert the rotational movement of the cams into corresponding translational (i.e. horizontal or vertical oscillational) movement of the respective elements for the X and Y warp yarns may be operated form a single axle, or a second axle 194 may be provided at right angle with axle 94, and each axle may be used to drive the elements of one of the systems.

In summary, the different elements for the X-weft system operate in the following order (the movement directions are defined in the coordinate system shown in FIGS. 1 and 2).

| STEP | ELEMENT | MOVEMENT |
|---|---|---|
| 1 | Yarn retainer | +Y |
| 2a | Yarn guide | +X |
| 2b | Needles | +Z |
| 3 | Guide deflector | −Y |
| 4 | Yarn retainer | −Y |
| 5 | Yarn guide assembly | −X |
| 6 | Needles | −Z |

The elements for the Y weft system are operated in the same sequence, after which the whole cycle is repeated.

In addition to the yarn guide and needle weaving scheme described above, alternate schemes may also be utilized for the same purpose. For example in the embodiment of FIG. 10 the weft yarn is attached to a guide bar 202 and needles 204 move horizontally through the warp yarns 206 as shown.

According to another embodiment shown in FIG. 11, yarn guide 210 moves weaves leaving yarn 212 through warp yarns 214. Opposite the yarn guide there is a shuttle or looper mechanism 216 which is used to loop another thread through the lacing yarn.

A cross-sectional view of the final product is shown in FIG. 12. Each weft yarn 78 and 178 is woven through warp yarns 74. At one side of the fabric the yarns are formed into loops 81 as consecutive courses of weft yarns in the X direction are laid or woven, each X course is interconnected to the previous X course at both ends; at one end the connection is made by the continuous X yarns. At the other end, the loops of the course engage the corresponding loop of the previous course. The courses in the Y direction are similarly interconnected. The X and Y courses alternate. In this description, a course comprises a plurality of parallel yarns oriented respectively either in the X or the Y direction which have been woven between the Z warp yarns during a single cycle as described above.

In the above description the term "yarn" has been used in a generic sense to describe the materials being interwoven in three dimensions. Its obvious that for an $m \times n$ material, $m \times n$ warp yarns; and $m+n+2$ weft yarns are used. Obviously these yarns can have different compositions. While the weft yarns have to be relatively flexible because they are bent at a fairly small radius of curvature, the warp yarns are held relatively straight so that they can be fairly stiff. The following materials could be used, although it is evident that other materials may be just as suitable as yarns: a single monofilament; a plurality of monofilaments (twisted or untwisted) made out of natural or manmade fibers; wires or rods made of copper, aluminum, graphite, steel, and so forth.

Obviously numerous modifications may be made to the subject invention without departing from its scope as defined in the appended claims. For example for relatively stiff warp yarn such as metallic rods, it may be more practical to move the forming bed longitudinally with respect to the rods rather than drawing the rods through the bed.

I claim:

1. A device for forming a three-dimensional fabric having warp yarns arranged in an array of rows and columns comprising:

a forming bed;

first means for pushing a first set of weft yarns along said rows from a first to a second position and back to said first position to form a first course across said forming bed;

second means for pushing a second set of weft yarns along said columns from a third to a fourth position and back to said third position;

means for interlocking longitudinally second courses across said former bed the weft yarns of each course with the corresponding weft-yarns of the preceeding course of the same set; and means for operating said first and second pushing means, and said interlocking means sequentially to form said first and second courses alternately transversally along said warp yarns.

2. The device of claim 1 wherein said first and second pushing means each comprise a plurality of parallel yarn guides, each having means for engaging a corresponding weft yarn.

3. The device of claim 2 wherein each yarn guide has a downwardly extending leg adapted to trap yarns disposed underneath said guide as said guide is moved across said bed.

4. The device of claim 1 further comprising first and second deflecting means for deflecting said first and second pushing means in said second position and forth position respectively, said first and second pushing means being adapted to wrap the weft yarns around said interlocking means as they are deflected by said deflecting means.

5. The device of claim 4 wherein said interconnecting means comprise needles which are moved between a fifth and a sixth position, and back to the fifth position, said needles being adapted to engage each weft yarn and to interlock the respective yarns of consecutive courses as they move between said fifth and sixth positions.

6. The device of claim 4 further comprising means of moving one of said fabric and forming bed with respect to the other.

7. A method of forming a three-dimensional fabric comprising:

providing a plurality of warp yarns arranged in an array of rows and columns;

pushing a first set of weft yarns along said rows to form a first course;

pushing a second set of weft yarns along said columns to form a second course, said first and second course being orthogonally oriented with respect to each other;

continuing forming first and second courses alternately along said warp yarns; and interlocking consecutive first courses and second courses as they are being formed at opposite ends.

8. The method of claim 7 wherein consecutive courses of said first set are interlocked by providing continuous yarns at one end, and interlocking the yarns of each course with the corresponding yarn of the next course.

9. The method of claim 8 wherein said first course is formed by pushing said first set of weft yarns from a first position to a second position and back to said first position along said rows to provide a first set of loops, and wherein consecutive courses are interlocked on said other side by pulling the loops of one course through the loops of the next course.

* * * * *

UNITED STATES PATENT AND TRADEMARK OFFICE

CERTIFICATE OF CORRECTION

PATENT NO. : 4,526,026

DATED : July 2, 1985

INVENTOR(S) : Konrad L. Krauland, Jr.

It is certified that error appears in the above-identified patent and that said Letters Patent is hereby corrected as shown below:

On the title page:

Change address of the inventor from "43 Ascan Ave., Forest Hills, N.Y. 11375" to --5 Sheffield Lane, Pottstown, Pennsylvania 19464--.

Signed and Sealed this

*Twenty-ninth* Day of *October 1985*

[SEAL]

*Attest:*

*Attesting Officer*

DONALD J. QUIGG

*Commissioner of Patents and Trademarks—Designate*